US005746410A

United States Patent [19]

Hung

[11] Patent Number: 5,746,410

[45] Date of Patent: May 5, 1998

[54] DOCUMENT HOLDING PANEL WITH A DEPRESSION BAR FOR INCREMENTALLY ADJUSTING AN INDEXING RULER

[76] Inventor: Teng-Shun Hung, No. 231, Jeu-Ren St., Pai-Ho Town, Tai-Nan Hsien, Taiwan

[21] Appl. No.: 709,333

[22] Filed: Sep. 5, 1996

[51] Int. Cl.[6] ..... A47B 63/00; B41J 29/15

[52] U.S. Cl. ..... 248/441.1; 248/452; 248/456; 400/718

[58] Field of Search ..... 248/451, 441.1, 248/444.1, 447, 452, 456, 457; 400/718

[56] References Cited

U.S. PATENT DOCUMENTS

| | | | |
|---|---|---|---|
| 456,089 | 7/1891 | Harrison | 248/452 |
| 634,922 | 10/1899 | Waldrip | 248/452 |
| 679,386 | 7/1901 | Lawton | 400/718 |
| 1,264,598 | 4/1918 | Beaton | 248/451 |
| 1,374,056 | 4/1921 | Beeghley | 400/718 |
| 5,052,650 | 10/1991 | Beile et al. | 248/451 |
| 5,193,772 | 3/1993 | Johnston | 248/441.1 X |
| 5,312,082 | 5/1994 | Chang | 248/441.1 X |
| 5,451,025 | 9/1995 | Hames | 248/452 X |
| 5,464,293 | 11/1995 | Hall | 400/718 |

FOREIGN PATENT DOCUMENTS

| | | | |
|---|---|---|---|
| 4-109907 | 4/1992 | Japan | 248/441.1 |
| 4-193204 | 7/1992 | Japan | 248/441.1 |

*Primary Examiner*—Robert W. Gibson, Jr.
*Assistant Examiner*—Stephen S. Wentsler
*Attorney, Agent, or Firm*—Bacon & Thomas

[57] ABSTRACT

The keying of a document is facilitated by securing the document in a holding panel and causing a ruler to be indexed downwardly across the document by pressing a depression bar which is operatively connected to the ruler by a toothed rack.

2 Claims, 8 Drawing Sheets

DOCUMENT HOLDING PANEL WITH A DEPRESSION BAR FOR INCREMENTALLY ADJUSTING AN INDEXING RULER

BACKGROUND OF THE INVENTION

The present invention relates to a document holding panel in which the s cale ruler is controlled and adjusted to move downward by one or two lines each time, whereby the position of the keyed in characters can be more clearly pointed out by the scale ruler according to the size of the character.

When using a keyboard to type an article or other documents into a computer, the user must attentively observe the original document. Therefore, the position and the way in which the document is placed is quite important to the efficiency of keying same in. In order to meet this requirement, a conventional document holding panel is shown in FIG. 1. Such panel includes a panel body 1, a securing clip 12 disposed on an upper side of the panel body 1 and a scale ruler 13 slidably disposed on a lateral side of the panel body 1. The periphery of the panel body 1 is formed with a rail 11 for the securing clip 12 or the scale ruler 13 to move therealong. In addition, the lower edge of the panel body 1 is provided with a hook-like rest 14 and a leg support 15 is pivotally connected with the back face of the panel body 1. When fixing the document on the panel, the leg support 15 is first stretched open to support place the panel on a desk. Then the document is placed on the rest 14 and clipped by the securing clip 12. The scale ruler 13 serves to indicate the position of the line of the document. The conventional document holding panel has several shortcomings as follows:

1. The scale ruler must be frequently moved to indicate the position of the keyed in line. The scale ruler is only secured to the rail of the panel body on one side. Therefore, when adjusted, the user must hold the panel body with one hand and adjust the scale ruler with the other hand. This causes inconvenience to the user and adversely affects working efficiency.

2. When manually adjusting the position of the scale ruler, the scale ruler is often over-adjusted and it is difficult to accurately adjust the position line by line.

SUMMARY OF THE INVENTION

It is therefore a primary object of the present invention to provide a typing document holding panel in which, by means of depressing a depression bar, a user can smoothly control and adjust the scale ruler with a single hand to move downward by one or two lines each time, whereby the position of the keyed in characters can be more clearly pointed out by the scale ruler according to the size and pitch of the line of characters.

The present invention can be best understood through the following description and accompanying drawings, wherein:

DETAILED DESCRIPTION OF THE PREFERRED EMBODIMENT

Figure 1:
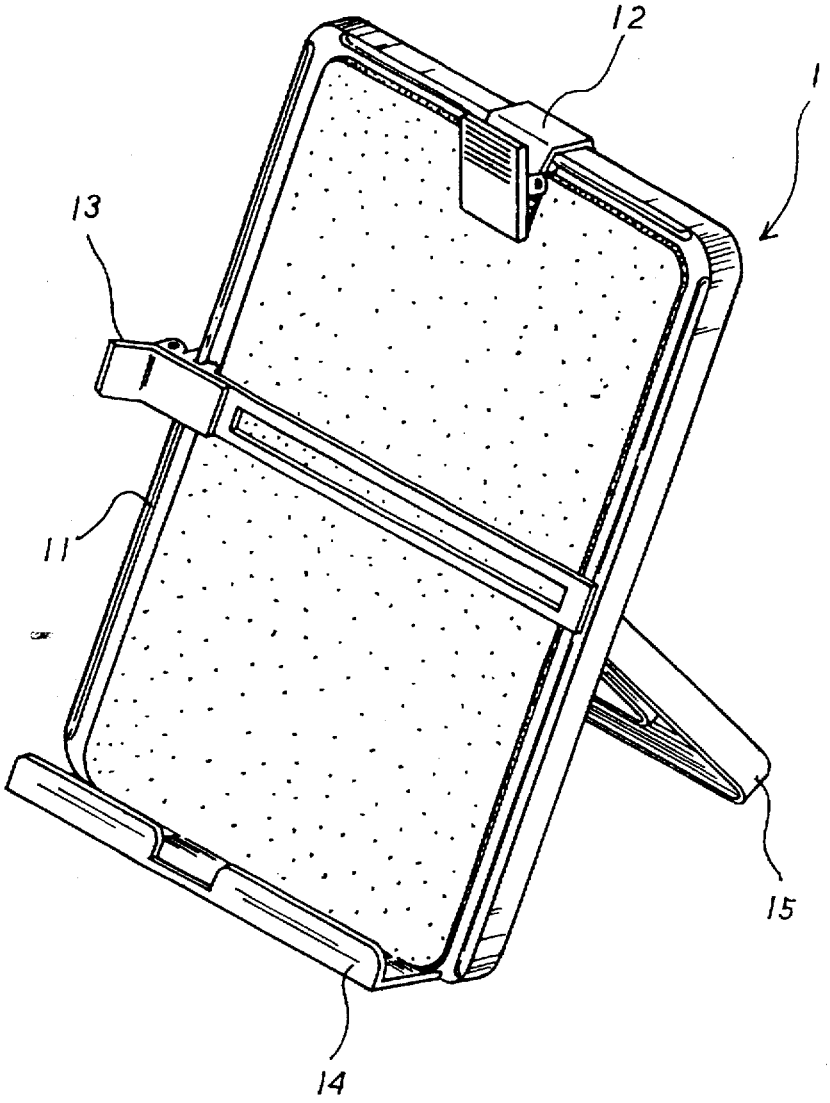
FIG. 1 PRIOR ART
FIG. 1 is a perspective view of a conventional document holding panel.
Figure 2:
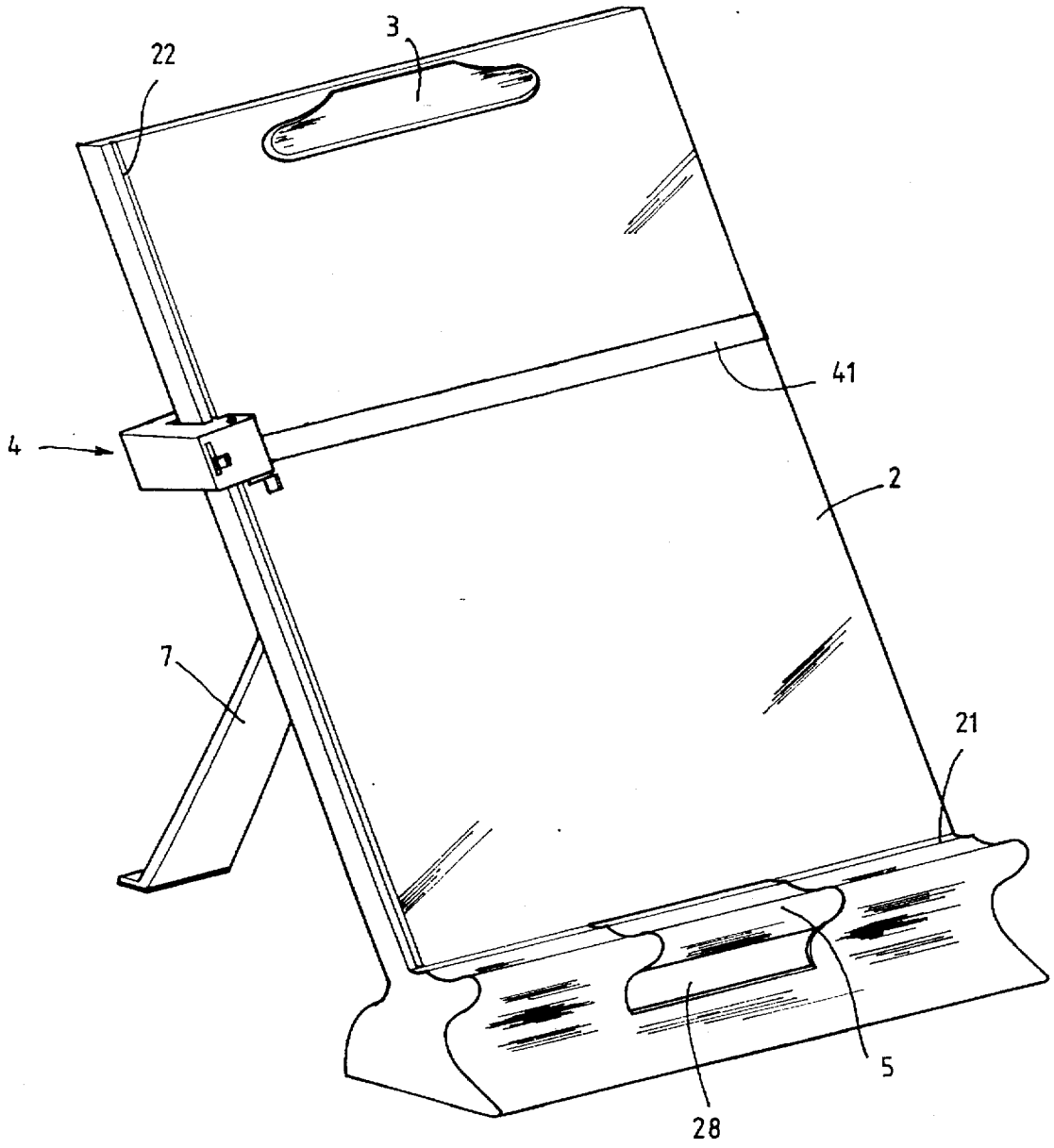
FIG. 2 is a perspective view of the present invention.
Figure 3:
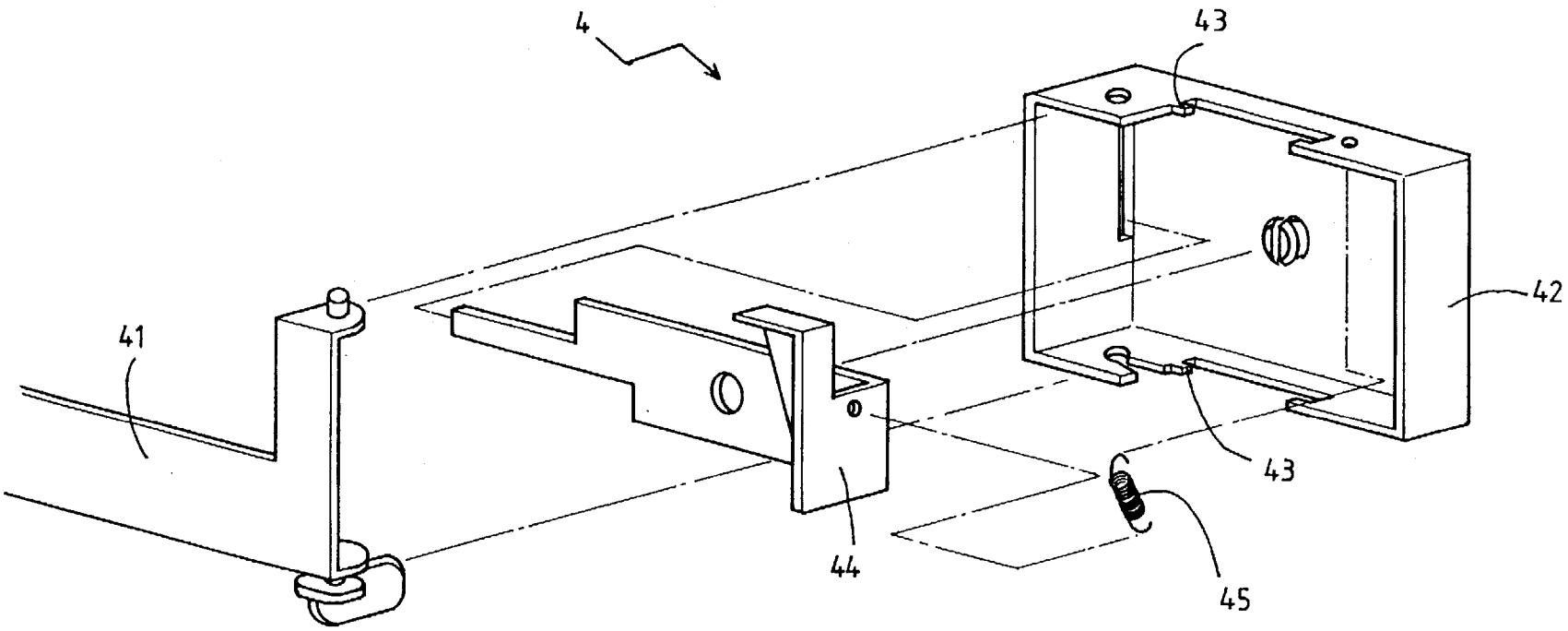
FIG. 3 is a perspective exploded view of the ruler locating device of the present invention.
Figure 4:
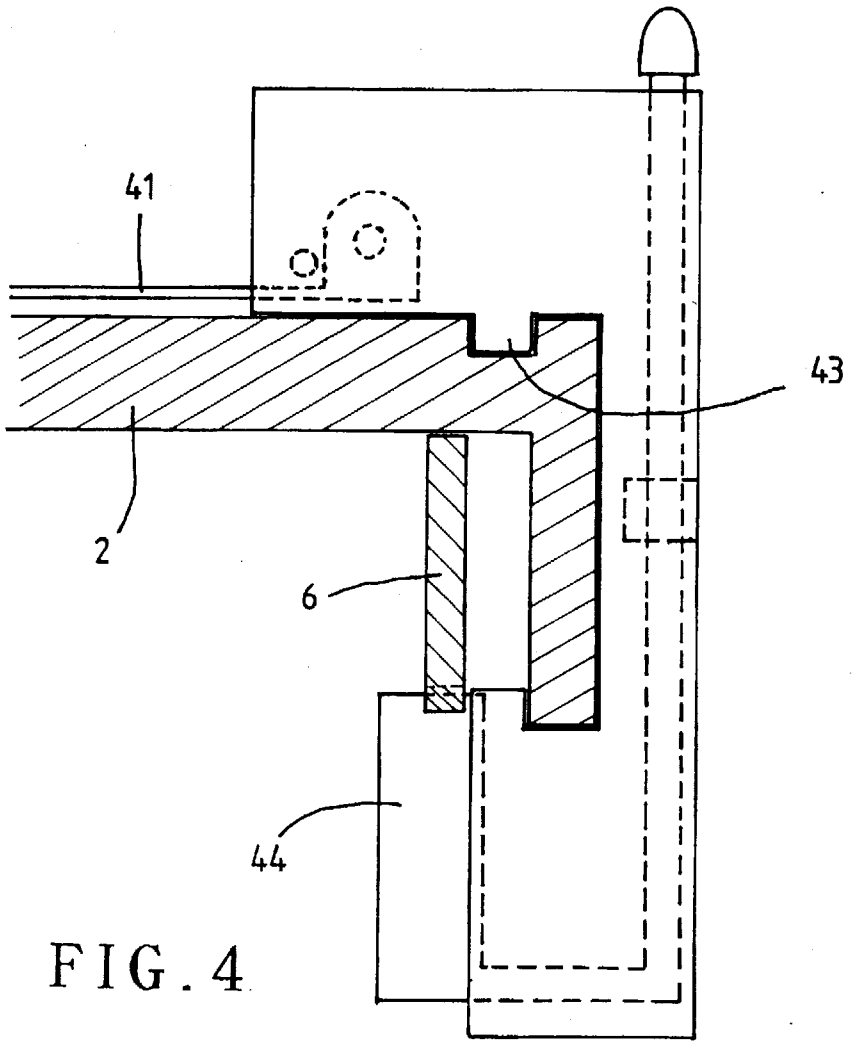
FIG. 4 is a top view of the ruler locating device of the present invention.
Figure 5:
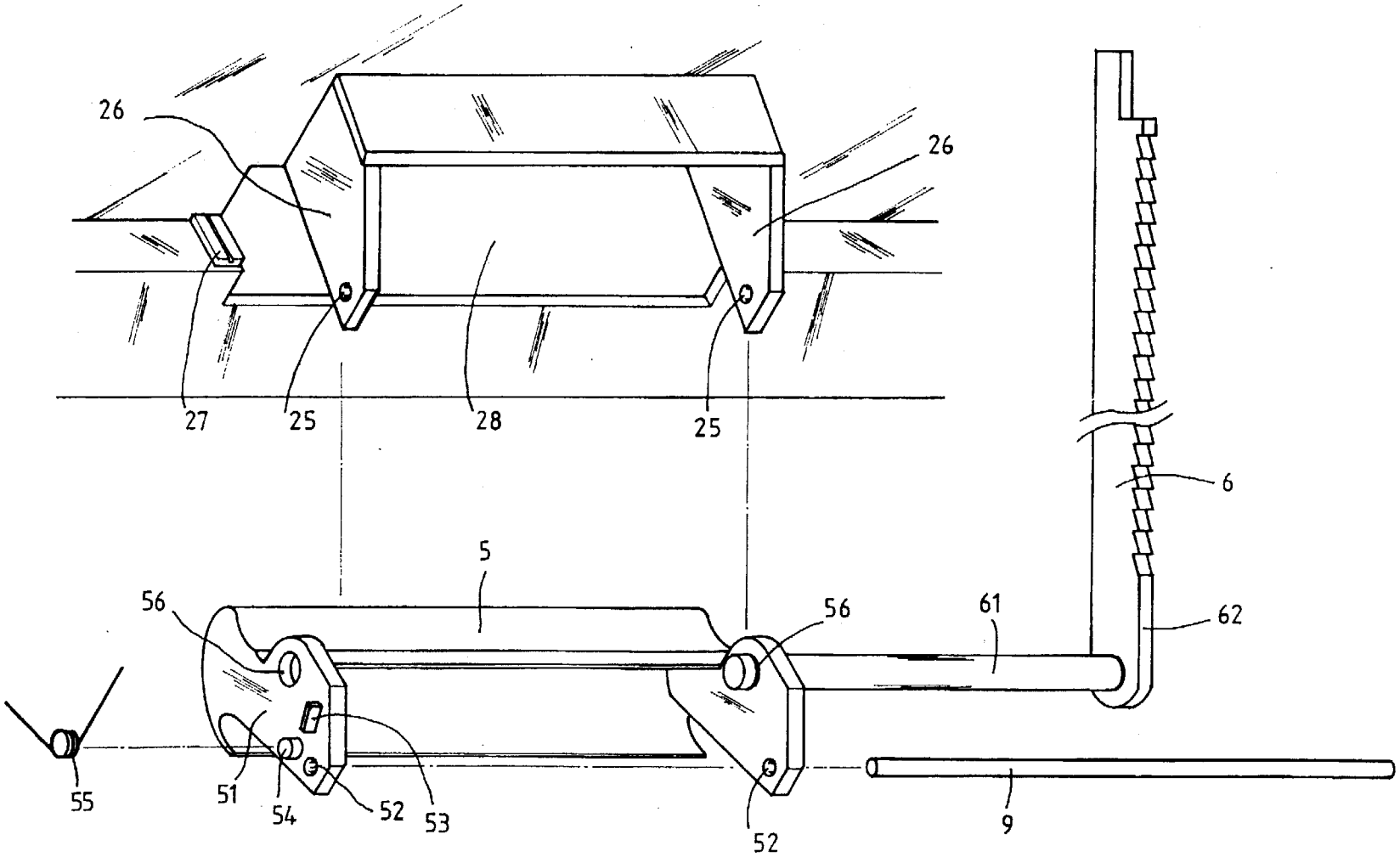
FIG. 5 is a perspective exploded view of the depression bar of the present invention.
Figure 6A:
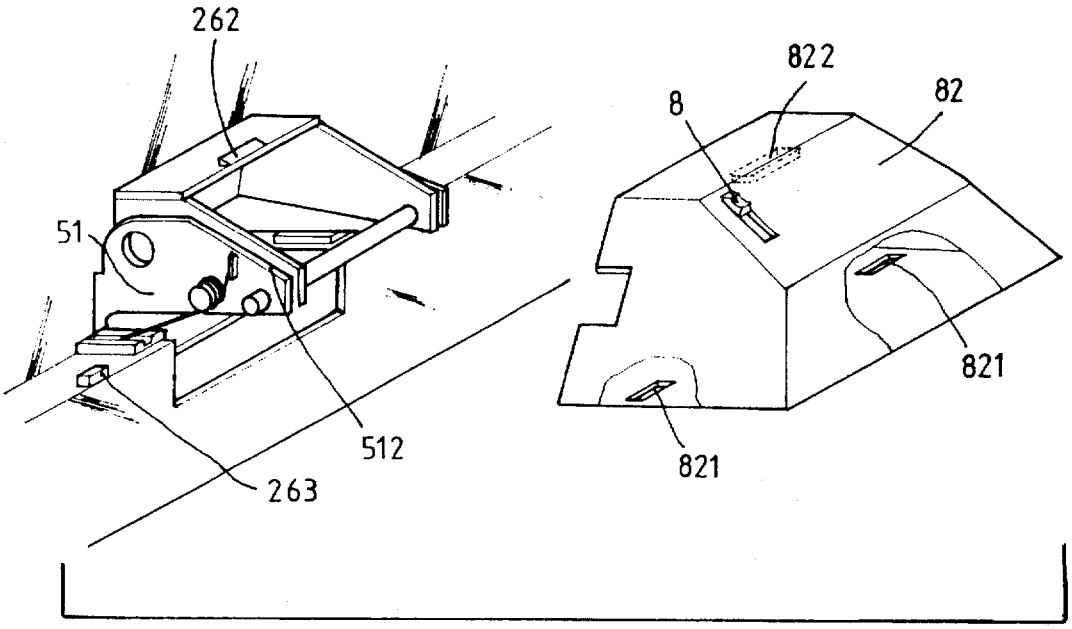
FIGS. 6 and 6A show the operation of the protective cover and restriction button of the present invention.
Figure 6:
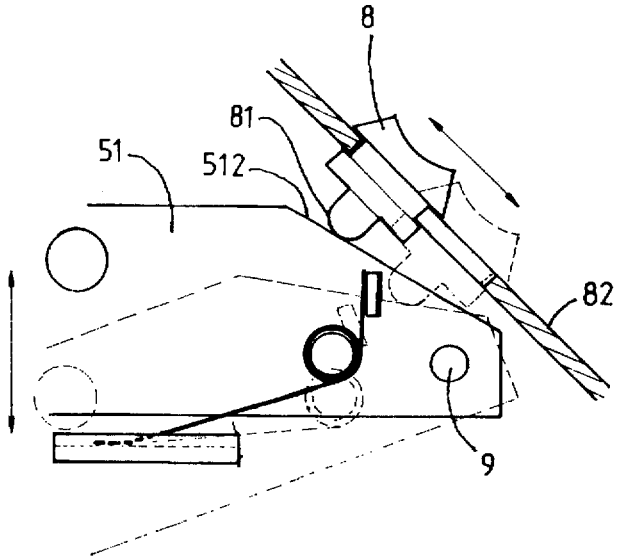
Figure 7:
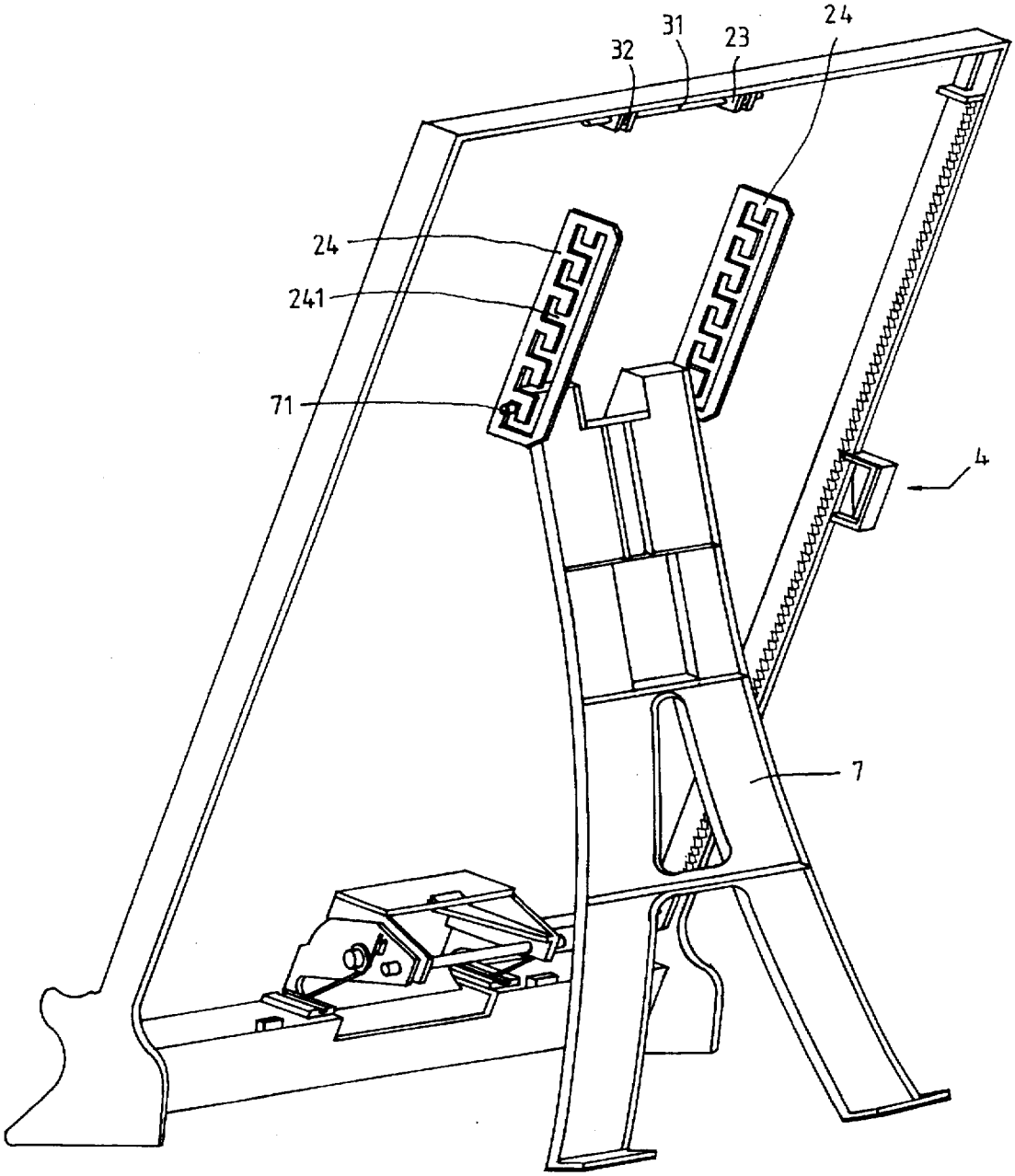
FIG. 7 is a rear perspective view of the present invention.
Figure 8:
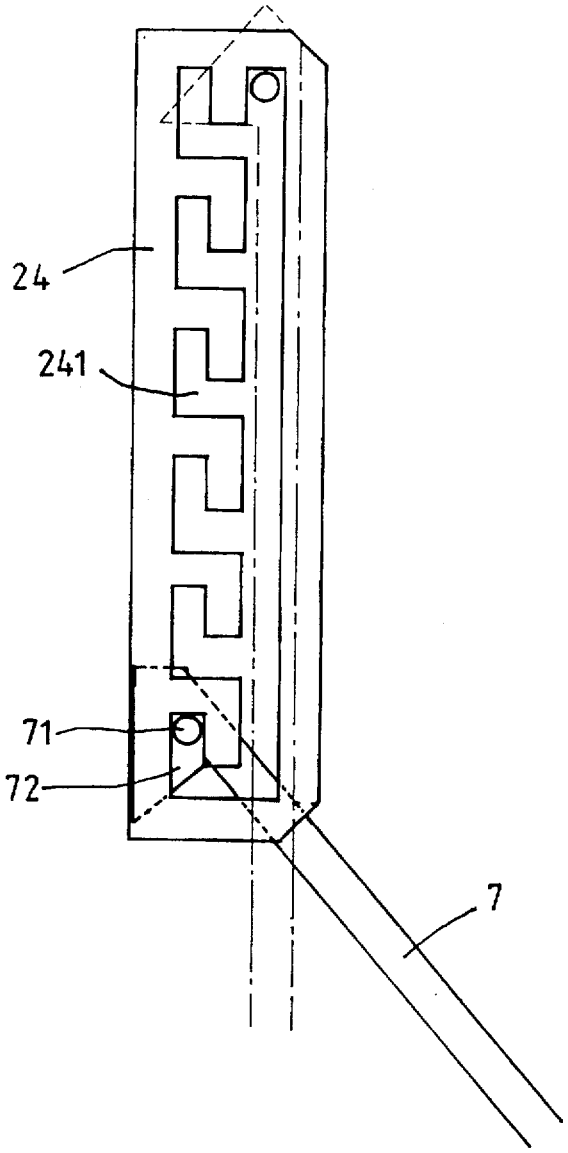
FIG. 8 shows the stretching/unstretching of the leg support of the present invention.

Please refer to FIGS. 2 through 8. The typing document holding panel of the present invention includes a panel body 2, a securing clip 3, a ruler locating device 4, a depression bar 5, a rack 6, a support leg 7 and a restriction button 8.

The panel body 2 is rectangular, having an arch rest board 21 at a lower end. A projecting plate 23 disposed at the upper end of the panel body 2 and a slot 28 is disposed at the lower end thereof. A lateral side of the panel body is formed with a channel 22. A leg support seat 24 is secured to the upper side of the back face. The lower side of the back face is disposed with retaining boards 26 formed with pivot holes 25. A stopper strip 27 is disposed beside the retaining board 26.

The securing clip 3 is pivotally connected with the projecting plate 23 via a circular rod 31 to provide a clipping force by means of a spring 32.

The ruler locating device 4 is composed of a scale ruler 41 and a locating device 42. The locating device 42 is provided with at least one projecting block 43 slidably fitted in the channel 22 to linearly reciprocate therein. A locating board 44 is pivotally connected to an outer side of the locating device 42 to achieve a locating effect via a spring 45 and a rack 6. The scale ruler 41 is pivotally connected on the locating device 42.

The depression bar 5 serves to control the ruler locating device 4 to move downward via the rack 6. A pivot bar 51 is fixed at each end of the depression board 5. The pivot board 51 is formed with a pivot hole 52 for pivotally connecting with the retaining board 26 via a shaft rod 9. The lateral side of the pivot board 51 is disposed with a stopper block 53 and a projecting boss 54 for the spring 55 to fit therewith and pivotally connect with the pivot hole 56 of the connecting rod 61. The other end of the connecting rod 61 is pivotally connected with the lower end of the rack 6.

The rack 6 has multiple downward inclined teeth and a plane face section 62 on a lower side.

The support leg 7 is A-shaped, having a pivot shaft 71 movably fitted in the adjusting hole 241 of the leg support seat 24. The upper end of the leg support 7 is disposed with a locating stopper block 72.

The restriction button 8 is slidably connected on the protective cover 82. By means of shifting the restriction button 8, a flange 81 on the lower side thereof abuts against the slope face 512 of the pivot board 51 so as to restrict the travel of the depression bar 5.

According to the above arrangement, the securing clip 3 is pivotally connected with the projecting plate 23 of the panel body 2 and the projecting block 43 is slidably fitted in the channel 22 of the panel body 2 so that the ruler locating device 4 can be slidably moved within the channel 22. In addition, the depression bar 5 connected with the pivot board 51 is placed into the slot 28, making the pivot hole 52 of the pivot board 51 pivotally connected to the pivot hole 25 of the retaining board 26 via a shaft rod 9. The spring 55 is fitted on the projecting boss 54 with two ends secured to the stopper block 53 and the stopper strip 27, whereby the depression bar 73 provided with a restoring resilient force. The restriction button 8 is slidably disposed on the protective cover 82 so as to restrict the restoring position of the pivot board 51. (The pivot board 51 is fixedly connected with the depression bar 5 so that the flange 81 of the restriction button 8 abuts against the slope face 512 of the pivot board 51 to change the degree of displacement for each descent. ) By means of the opening 821 and recess 822 of the protective cover 82, the protective cover 82 is secured to the projecting block 263 and engaging hook 262. In addition, the leg support 7 is pivotally connected with the leg support seat 24 to complete the assembly.

When using the present invention, the leg support 7 is first stretched open to a suitable angle to determine the selected adjusting hole 241 so as to stably support the present invention. Then the document is fixed by the securing clip 3 and the locating board 44 is biased upward to disengage from the rack 6 and drive the ruler locating device 4 to move upward and bridge the scale ruler 41 over the document. Moreover, according to the size of the character, the restriction button 8 is set to move one or two lines each time. When the user depresses the depression bar 5, by means of the engagement between the pivot board 51 and the rack 6, the rack 6 is driven to move downward. By means of the engagement between the rack 6 and the locating board 44, when the rack 6 moves downward, the ruler locating device 4 is driven to move downward, whereby the scale ruler 41 can sequentially point out each line of the document. When the depression bar 5 is free from the depression force, the spring 55 fitted with the projecting boss 54 of the pivot board 51 will cause the depression bar 5 to restore to its original position along with the rack 6. Although the rack 6 still touches the locating board 44 when restored, because the rack 6 is moved upward along the inclined face of the teeth, the ruler locating device 4 will not be pushed back to its original position. When the ruler locating device 4 is moved to the lowermost position by means of continuously depressing the depression bar 5, because the locating board 44 leans against the plane face section 62 of the rack 63, the rack is prevented from being damaged due to over-forcing. In addition, when the ruler locating device 4 is pushed back to the upper end of the panel board 2, the user only needs to bias the locating board 44 upward, making the end of the locating board 44 disengage from the rack 6 and move upward.

The above embodiment is only an example of the Present invention and the scope of the present invention should not be limited to the example. Any modification or variation derived from the example should fall within the scope of the appended claims.

What is claimed is:

1. A document holding panel comprising:

a) a panel body, a securing clip, a ruler locating device, a depression bar, a rack, a leg support, and a restriction button; wherein b) the panel body is rectangular, having an arch rest board at a lower end of the panel body, a projecting plate being disposed at an upper end of the panel body and a slot being disposed at the lower end of the panel body, a lateral side of the panel body being formed with a channel, a leg support seat being secured to an upper side of the back face of the panel body, a lower end of the back face being disposed with a stopper strip and a plurality of retaining boards, each retaining board formed with a pivot hole;

c) the securing clip is pivotally connected with the projecting plate via a circular rod to provide a clipping force by means of a spring;

d) the ruler locating device is composed of a scale ruler and a locating device, the locating device being disposed with at least one projecting block slidably fitted into the channel to linearly reciprocate therein, a locating board being pivotally connected to an outer side of the locating device to achieve a locating effect via a spring and a rack;

e) the depression bar is located in the slot and serves to control the ruler locating device to move downward via the rack, a pivot board being fixed at each end of the depression bar, the pivot board being formed with a pivot hole pivotally connecting with the pivot holes of the retaining boards via a shaft rod, a lateral side of the pivot board being disposed with a stopper block and a projecting boss, a spring fitted on the projecting boss with two ends secured to the stopper block and the stopper strip, whereby the spring on the projection boss provides the depression bar with a resilient restoring force, the pivot board having another pivot hole, a connecting rod pivotally connected with another pivot hole on one end of the connecting rod, the other end of the connecting rod being pivotally connected with a lower end of the rack;

f) the rack has multiple downward inclined teeth and a plane face section on the lower end of the rack; and g) the restriction button is slidably connected on a protective cover, by means of sliding the restriction button, a flange on the lower side of the restriction button abuts against a slope face of the pivot board so as to restrict the restoring position of the pivot board and restrict the travel of the depression bar.

2. The document holding panel of claim 1 wherein the depression bar is drivingly connected with the rack via the pivot board for controlling downward movement of the ruler locating device.

* * * * *